US006610110B1

(12) United States Patent
Manka

(10) Patent No.: US 6,610,110 B1
(45) Date of Patent: Aug. 26, 2003

(54) AVIATION FUELS HAVING IMPROVED FREEZE POINT

(75) Inventor: John S. Manka, Chardon, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 09/502,131

(22) Filed: Feb. 11, 2000

(51) Int. Cl.[7] ..... C10L 1/18; C10L 1/22
(52) U.S. Cl. ..... 44/331; 44/386
(58) Field of Search ..... 44/331, 386

(56) References Cited

U.S. PATENT DOCUMENTS

| | | | | | |
|---|---|---|---|---|---|
| 2,993,771 | A | | 7/1961 | Stromberg | 52/0.5 |
| 3,037,051 | A | | 5/1962 | Stromberg | 260/485 |
| 3,048,479 | A | | 8/1962 | Ilnyckyj et al. | 44/62 |
| 3,088,815 | A | | 5/1963 | Haney et al. | 44/71 |
| 3,304,261 | A | | 2/1967 | Ilnyckji et al. | 252/56 |
| 3,337,313 | A | | 8/1967 | Otto | 44/62 |
| 3,341,309 | A | | 9/1967 | Ilnyckyj | 44/62 |
| 3,640,691 | A | | 2/1972 | Ilnyckyj et al. | 44/62 |
| 3,676,483 | A | * | 7/1972 | Hu | 44/331 |
| 3,883,318 | A | | 5/1975 | Feldman et al. | 44/62 |
| 4,559,155 | A | | 12/1985 | Dorer et al. | 252/73 |
| 4,780,111 | A | * | 10/1988 | Dorer et al. | 44/331 |
| 4,880,553 | A | | 11/1989 | Kostusyk et al. | 252/58 |
| 5,039,306 | A | * | 8/1991 | Baillargeon et al. | 44/331 |
| 5,092,908 | A | | 3/1992 | Feldman et al. | 44/380 |
| 5,284,493 | A | * | 2/1994 | Baillargeon et al. | 44/331 |
| 5,456,731 | A | * | 10/1995 | Blain et al. | 44/331 |
| 5,755,834 | A | | 5/1998 | Chandler | 44/386 |
| 5,788,722 | A | * | 8/1998 | Emert et al. | 44/386 |

FOREIGN PATENT DOCUMENTS

| | | | |
|---|---|---|---|
| CA | 676875 | 12/1963 | |
| EP | 0857 776 A1 | 8/1998 | C10L/1/14 |
| GB | 848777 | 9/1960 | |
| GB | 993744 | 6/1965 | |
| GB | 1 208 766 | 10/1970 | |

OTHER PUBLICATIONS

Ervin et al., *Energy & Fuels* (1999) 13, 1246–1251, "Investigation of the Use of JP–8+100 with Cold Flow Enhancer Additives as a Low–Cost Replacement for JPTS".

* cited by examiner

*Primary Examiner*—Jacqueline V. Howard
(74) *Attorney, Agent, or Firm*—Michael F. Esposito; Jeffrey F. Munson

(57) ABSTRACT

A novel aviation fuel characterized by having a low freeze point (typically no higher than −40° C.) comprising a mixture of an aviation fuel and a compound selected from at least one member of the group consisting of (1) the reaction product of an alkanol amine with a hydrocarbyl-substituted acylating agent wherein the hydrocarbyl group comprises a substantially linear alkyl or alkenyl group containing an average of about 8 to about 50 carbon atoms; or (2) the reaction product of (a) substantially linear hydrocarbyl-substituted phenol wherein the hydrocarbyl substituent contains an average of about 8 to about 40 carbon atoms with an aldehyde or a source thereof having between 1 to 10 carbon atoms; or (3) aromatic moieties containing from about 1 to 3 aromatic rings wherein the aromatic moieties contains up to three substituents hydrocarbyl substantially linear constituents having from about 1 to 50 carbon atoms and the aromatic moieties are coupled by alkylene groups having 1 to 100 carbon atoms; or (4) an ethylene vinyl acetate copolymer having a number average molecular weight of between about 2,500 to 10,000 with a mole percent ethylene to vinyl acetate ratio of between about 65:35 to 85:15.

14 Claims, No Drawings

AVIATION FUELS HAVING IMPROVED FREEZE POINT

BACKGROUND OF THE INVENTION

The present invention is directed to the use of additives to depress (lower) the freeze point of aviation fuels. In particular, the present invention is directed to the use of specific additives to lower the freeze point of jet fuels.

The freeze point for aviation fuels is defined as the fuel temperature at which solid hydrocarbon crystals, formed on cooling, disappear when the temperature of the fuel is allowed to rise. The freeze point of aviation fuels is measured typically by the ASTM D2386-97, D5901-96 or D5972-96 test methods.

It is absolutely essential that aviation fuel have a freeze point sufficiently low to preclude interference with flow of fuel through filter screens to the engines at temperatures prevailing at high altitudes. The temperature of fuel in an aircraft fuel tank decreases at a rate proportional to the duration the flight. Therefore, the maximum freeze point allowed for the fuel is usually related to the type of flight. That is, long duration flights would usually require fuel of a lower freeze point than short duration flights. However, an exception to this general rule may occur during military combat operation where the aircraft are operated at a significant higher altitude. In this case, lower freeze point jet fuel may be required due to the higher altitude although the duration of the flight is typically shorter.

Various patents teach the addition of pour depressants to middle distillates, such as heating oils and diesel fuels, to improve their cold flow properties. For example, various polymers, useful as middle distillate pour point depressants prepared from ethylene, have been described in the patent literature. These pour depressants include copolymers of ethylene and vinyl esters of lower fatty acids such as vinyl acetate (U.S. Pat. No. 3,048,479); copolymers of ethylene and alkyl acrylate (Canadian Patent No. 676,875); terpolymers of ethylene with vinyl esters and alkyl fumarates (U.S. Pat. Nos. 3,304,261 and 3,341,309); polymers of ethylene (British Patent Nos. 848,777 and 993,744); chlorinated polyethylene (Belgian Patent No. 707,371 and U.S. Pat. No. 3,337,313). In addition, U.S. Pat. Nos. 5,092,908 and 3,883,318 teach the combinations of a pour depressant with a middle distillate which may include jet fuels to lower the pour point of the distillate.

However, typically low jet fuel freeze points are attained by changing the distillation cut points or component blending to produce a jet/aviation fuel having an acceptable freeze point. The present invention is directed to a chemical treatment of the aviation fuel which not only lowers the freeze point of the jet/aviation fuel beyond the freeze point obtained by blending alone, but also achieves this result at a substantially lower cost.

SUMMARY OF THE INVENTION

It is the primary object of the present invention to provide a novel jet fuel composition having a low freeze point with improved low temperature filterability.

It is another object of the present invention to provide a novel process for producing a low freeze point jet fuel with improved low temperature filterability.

Additional objects and advantages of the present invention will be set forth in the description which follows and, in part, will be obvious from the description or may be learned by the practice of the invention. The objects and advantages of the invention may be realized by means of the instrumentalities and combinations pointed out in the appended claims.

To achieve the foregoing object and in accordance with the purpose of the invention as embodied and broadly described herein, the improved aviation fuel composition of the present invention comprises a mixture of an aviation fuel and a compound selected from at least one member of the group consisting of (1) the reaction product of an alkanol amine with a hydrocarbyl-substituted acylating agent wherein the hydrocarbyl group comprises a substantially linear alkyl or alkenyl group which contains an average of about 8 to about 50 carbon atoms; or (2) the reaction product of (a) substantially linear hydrocarbyl-substituted phenol wherein the hydrocarbyl substituent contains an average of about 8 to about 40 carbon atoms with an aldehyde or a source thereof having between 1 to 10 carbon atoms; or (3) an aromatic moieties containing from about 1 to 3 aromatic rings wherein the aromatic moieties contains up to three substituents substantially linear hydrocarbyl constituents having from about 1 to 50 carbon atoms and the aromatic moieties are coupled by alkylene groups having 1 to 100 carbon atoms; or (4) an ethylene vinyl acetate copolymer having a number average molecular weight of between about 2,500 to 10,000 with a mole percent ethylene to vinyl acetate ratio of between about 65:35 to 85:15.

In a further aspect of the present invention, a process for lowering the freeze point of aviation fuel comprises adding to the aviation fuel in an amount sufficient to lower the freeze point of the aviation fuel a compound selected from at least one member of the group consisting of (1) the reaction product of an alkanol amine with a hydrocarbyl-substituted acylating agent wherein the hydrocarbyl comprises a substantially linear alkenyl or alkyl group which contains an average of about 8 to about 50 carbon atoms; or (2) the reaction product of (a) substantially linear hydrocarbyl-substituted phenol wherein the hydrocarbyl substituent contains an average of about 8 to about 40 carbon atoms with an aldehyde or a source thereof having between 1 to 10 carbon atoms; or (3) an aromatic moieties containing from about 1 to 3 aromatic rings wherein the aromatic moieties contains up to three substituent substantially linear hydrocarbyl constituents having from about 1 to 50 carbon atoms and the aromatic moieties are coupled by alkylene groups having 1 to 100 carbon atoms; or (4) an ethylene vinyl acetate copolymer having a number average molecular weight of between about 2,500 to 10,000 with a mole percent ethylene to vinyl acetate ratio of between about 65:35 to 85:15.

It should be understood that the term "substantially linear hydrocarbyl" generally means a linear content of at least 50%, preferably at least 75%, especially preferred being at least 90%.

In a preferred embodiment of the present invention, the aviation fuel is selected to be Jet Fuel A.

In another preferred embodiment of the present invention the aviation fuel is selected to be Jet Fuel A-1.

In still another preferred embodiment of the present invention the aviation fuel is selected to be Jet Fuel 8+100.

DETAILED DESCRIPTION OF THE PRESENT INVENTION

Reference will now be made in detail to the present preferred embodiment of the invention.

The present invention is directed to lowering the freeze point of jet fuels. In particular, the present invention comprises the combination of Jet Fuel A (as specified in *Jet Fuel Specification* (1995 Edition published by Exxon), Jet Fuel A-1, (as specified in ASTM designation D-1655-93(a)), Jet Fuel 8 and/or Jet Fuel 8+100 (Jet Fuel 8 plus additive package) with a specific freeze point composition to provide an improved jet fuel possessing not only a lower freeze point but also capable of easy formulation resulting in significant economical savings.

The improved aviation fuel of the present invention comprises a mixture of an aviation fuel preferably an aviation (jet) fuel having a freeze point no higher than −40° C., preferably no higher than −47° C. and a freeze point depressant composition comprising one of the four following compositions or mixtures thereof.

Depressant Composition I

The first freeze point depressant composition useful in the practice of the present invention comprises the reaction product of an alkanol with a hydrocarbyl-substituted acylating agent wherein the hydrocarbyl comprises a substantially linear alkenyl or alkyl group which contains an average of about 8 to about 50 carbon atoms.

Typical hydrocarbyl substituted acylating agents may comprise $C_8$ to $C_{50}$ alkenyl succinic anhydride, preferably a $C_{12}$ to $C_{35}$ alkenyl succinic anhydride, especially preferred being a $C_{18}$ to $C_{30}$ alkenyl succinic anhydride.

Typical alkanol amines suitable in the practice of the present invention comprise diethanolamine, dipropanolamine, dibutanolamine, N-methyl ethanolamine, N-ethyl ethanolamine, especially preferred being diethanolamine.

Depressant Composition (II)

The second freeze point depressant useful in the practice of the present invention comprises the reaction product of (a) substantially linear hydrocarbyl-substituted phenol wherein the hydrocarbyl substituent contains an average of about 8 to about 40 carbon atoms and (b) an aldehyde or a source thereof having between 1 to 10 carbon atoms Hydrocarbyl-substituted phenols are known materials, as is their method of preparation. When the term "phenol" is used herein, it is to be understood that this term is not generally intended to limit the aromatic group of the phenol to benzene (unless the context so indicates, for instance, in the Examples), although benzene may be the preferred aromatic group. Rather, the term is to be understood in its broader sense to include hydroxy aromatic compounds in general, for example, substituted phenols, hydroxy naphthalenes, and the like. Thus, the aromatic group of a "phenol" can be mononuclear or polynuclear, substituted, and can include other types of aromatic groups as well.

Preferably, the aldehyde is selected to have between about 1–6 carbon atoms, especially preferred being 1–3 carbon atoms. Typical sources of aldehydes include formalin, paraformaldehyde, "trimethyl trioxane". Typical, examples of suitable aldehydes include formaldehyde, acetaldehyde, isobutyraldehyde, butanal, propanal, heptanal, 2-ethylhexanal, and glyoxylic acid.

Depressant Composition (III)

Freeze point depressant (III) comprises an aromatic compound containing from about 1 to 3 aromatic rings wherein the aromatic compound contains up to three hydrocarbyl constituents having from about 1 to 50 carbon atoms and the aromatic compounds are coupled by alkylene groups having 1 to 100 carbon atoms.

The aromatic group can thus be a single aromatic such as benzene or a polynuclear aromatic moiety. Such polynuclear moieties can be of the fused type; that is, wherein pairs of aromatic nuclei making up the aromatic group share two points, such as found in naphthalene, anthracene, the azanaphthalenes, etc. Polynuclear aromatic moieties also can be of the linked type wherein at least two nuclei (either mono or polynuclear) are linked through bridging linkages to each other. Such bridging linkages can be chosen from the group consisting of carbon-to-carbon single bonds between aromatic nuclei, ether linkages, keto linkages, sulfide linkages, polysulfide linkages of 2 to 6 sulfur atoms, sulfinyl linkages, sulfonyl linkages, methylene linkages, alkylene linkages, di-(lower alkyl) methylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages. In certain instances, more than one bridging linkage can be present in the aromatic group between aromatic nuclei. For example, a fluorene nucleus has two benzene nuclei linked by both a methylene linkage and a covalent bond. Such a nucleus may be considered to have 3 nuclei but only two of them are aromatic. Normally, the aromatic group will contain only carbon atoms in the aromatic nuclei per se, although other non-aromatic substitution, such as in particular short chain alkyl substitution can also be present. Thus methyl, ethyl, propyl, and t-butyl groups, for instance, can be present on the aromatic groups, even though such groups may not be explicitly represented in structures set forth herein.

For such reasons as cost, availability, performance, etc., the aromatic group is normally a benzene nucleus, a lower alkylene bridged benzene nucleus, or a naphthalene nucleus. Most preferably, the aromatic group is a napthalene nucleus.

Depressant Composition (IV)

Freeze Point Depressant (IV) which is suitable for depressing the freeze point of aviation fuels, in particular, Jet Fuel A and Jet Fuel A1, Jet Fuel 8 and Jet Fuel 8+100 (as defined previously) comprises an ethylene vinyl acetate copolymer having a number average molecular weight of between 2,500 to 10,000 with a mole percent ethylene to vinyl acetate ratio of between about 65:35 to 85:15. Preferably, the average molecular weight ranges from 2,500 to 4,000 and especially preferred being from 2,850 to 3,250. Preferably, the mole percent ethylene to vinyl acetate ratio between about 65:35 to 80:20, preferred 75:25 to 80:20, especially preferred being about 76:24 to 79:21.

For purposes of this specification, it should be understood that the term "hydrocarbyl substituent" or "hydrocarbyl group" is used herein in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Preferably the hydrocarbyl group is an alkyl group. Typically the alkyl group will contain 10 to 40 carbon atoms, preferably 15 to 35 carbon atoms, especially preferred being 20–30 carbon atoms.

The hydrocarbyl group can be derived from the corresponding olefin; for example, a $C_{26}$ alkyl group is derived from a $C_{26}$ alkene, preferably a 1-alkene, a $C_{34}$ alkyl group is derived from a $C_{34}$ alkene, and mixed length groups are derived from the corresponding mixture of olefins. When the hydrocarbyl group is a hydrocarbyl group having between 20 to 30 carbon atoms, however, it is frequently an aliphatic group (or a mixture of such groups) made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. For suitable use as a pour point depressant, at least a portion of the alkyl group or groups is preferably straight chain, that is, substantially linear.

The following examples of the present invention set forth below are for illustrative purposes only.

Table I below sets forth comparative data obtained during testing of Jet Fuel A with known depressants having composition outside the scope of the present invention and compositions within the scope of the present invention. The Freeze Point was measured utilizing ASTM Procedure D-2386-97. Typically, the depressant compound is added in the range of about 50 to 600 ppm (volume basis), preferably about 75 to 500 ppm, especially preferred being about 100 to 450 ppm, in particular 100 to 300 ppm.

TABLE I

Jet Fuel Freeze Point Evaluation Composite Jet A

| Sample Number | Additive | Equal Active Treat Rate (ppm) | Freeze Point in ° F. |
|---|---|---|---|
| 1 (comp) | None | — | −51.0 |
| 2 (comp) | A | 200 | −49.0 |
| 3 (comp) | B | 200 | −43.6 |
| 4 (comp) | C | 200 | −32.8 |
| 5 (comp) | D | 200 | −40.0 |
| 6 (comp) | E | 400 | −29.2 |
| 7 Invention | (II) | 200 | −52.6 |
| 8 Invention | (III) | 200 | −50.8 |
| 9 Invention | (I) | 200 | −56.2 |
| 10 Invention | (IV) | 200 | −58.0 |

A is a Di ($C_{12}$–$C_{14}$) fumarate, vinylacetate, vinylethylether polymer.

B is a 2-butenedioic acid (E)-, di-$C_{12}$–$C_{18}$-alkyl esters, polymers with vinyl acetate C is a vinyl acetate polymer with $C_{18}$–$C_{22}$ fumarate D is a 2-butenedioic acid (E)-, di-$C_{12}$–$C_{22}$ alkyl esters, polymers with vinyl acetate E is a maleic anhydride-styrene-methacrylate polymer esterified with Alfol 1218 and Nafol 1822. (Alfol 1218 is a high purity petrochemical based linear primary alcohol with even number of carbon atom chain lengths; Nafol 1822 is a linear fatty ester.

Both Alfol 1218 and Nafol 1822 may be obtained from Condea Vista Chemical Co. located in Houston, Tex.)

(I) a $C_{18}$–$C_{24}$ succinic anhydride reacted with diethanol amine (composition (1) of the present invention);

(II) a napthalene reacted with a $C_{20}$ alkyl chloride and a $C_{16}$–$C_{18}$ alpha olefins (composition III of the present invention);

(III) a methylene coupled $C_{24}$–$C_{28}$ alkyl phenol (composition (II) of the present invention; and (IV) an ethylene-vinyl acetate copolymer having a number average molecular weight of 3170 and a mole % ratio ethylene/vinyl acetate of 78.4:21.6 (obtained from Equistar Chemicals LP, located in Cincinnati, Ohio).

Table II below sets forth further comparative data obtained during testing of Jet Fuel A-1 (JP-8) with the same freeze point depressant utilized in Table I. The Freeze Point was measured utilizing ASTM D2386-97.

TABLE II

Freeze Point Evaluation of Composite Jet Fuel A-1 (JP-8)

| Sample Number | Additive | Equal Active Treat Rate (ppm) | Freeze Point in F. |
|---|---|---|---|
| 11 (comp) | None | — | −82.3 |
| 12 (comp) | A | 200 | −72.0 |
| 13 (comp) | B | 200 | −43.6 |
| 14 (comp) | C | 200 | −59.8 |
| 15 (comp) | D | 200 | −25.6 |
| 16 (comp) | E | 400 | −36.4 |
| 17 Invention | (II) | 200 | −86.8 |
| 18 Invention | (III) | 200 | −86.8 |
| 19 Invention | (I) | 200 | −83.2 |
| 20 Invention | (IV) | 200 | −83.2 |

The results set forth above demonstrate the unexpected superior results obtained utilizing the freeze point depressant of the present invention in combination with aviation fuels. Table I and II demonstrate the unpredictability of utilizing known pour point depressants in combination with aviation fuels. For example, Examples 2–6 (Table I) and 12–16 (Table II), clearly show that certain classes of known pour point depressants for fuels will not work and, in fact, will detrimentally affect the freeze point of aviation fuels. The compositions of the present invention provide unexpected improvement in lowering the freeze point of aviation fuel which produces unexpectedly superior results.

What is claimed is:

1. An aviation fuel composition comprising a mixture of an aviation fuel and a compound capable of lowering the freeze point of the aviation fuel wherein the compound is a reaction product of an alkanol amine with a hydrocarbyl-substituted acylating agent wherein the hydrocarbyl group comprises a substantially linear alkyl or alkenyl group containing an average of about 8 to about 50 carbon atoms;

wherein the alkanol amine is diethanolamine, dipropanolamine, dibutanolamine, N-methyl ethanolamine, or N-ethyl ethanolamine;

and wherein the aviation fuel is Jet Fuel A, Jet Fuel A-1, Jet Fuel 8 or Jet Fuel 8+100.

2. The mixture of claim 1 wherein the aviation fuel has a freeze point no higher than −40° C.

3. The mixture of claim 1 wherein the compound is present in the range of about 50 to 600 ppm.

4. The mixture of claim 1 wherein the compound is present in the range of about 75 to 500 ppm.

5. The mixture of claim 1 wherein the compound is present in the range of about 100 to 450 ppm.

6. The composition of claim 1 further comprising a member selected from the group consisting of (1) a reaction product of (a) substantially linear hydrocarbyl-substituted phenol wherein the hydrocarbyl substituent contains an average of about 8 to about 40 carbon atoms with an aldehyde or a source thereof having between 1 to 10 carbon atoms;

(2) aromatic moieties containing from about 1 to 3 aromatic rings wherein the aromatic moieties contain up to three substituents hydrocarbyl substantially linear constituents having from about 1 to 50 carbon atoms and the aromatic moieties are coupled by alkylene groups having 1 to 100 carbon atoms;

(3) an ethylene vinyl acetate copolymer having a number average molecular weight of between about 2,500 to 10,000 with a mole percent ethylene to vinyl acetate ratio of between about 65:35 to 85:15; and (4) mixtures thereof.

7. The composition of claim 2 wherein the hydrocarbyl-substituted acylating agent is an alkenyl succinic anhydride.

8. A process for lowering the freeze point of aviation fuel comprising adding to the aviation fuel in an amount sufficient to lower the freeze point of the aviation fuel a compound wherein the compound is a reaction product of an alkanol amine with a hydrocarbyl-substituted acylating agent wherein the hydrocarbyl group comprises a substantially linear alkenyl or alkyl group containing an average of about 8 to about 50 carbon atoms;

wherein the alkanol amine is diethanolamine, dipropanolamine, dibutanolamine, N-methyl ethanolamine, or N-ethyl ethanolamine;

and wherein the aviation fuel is Jet Fuel A, Jet Fuel A-1, Jet Fuel 8 or Jet Fuel 8+100.

9. The process of claim 8 wherein the aviation fuel is selected to have a freeze point of no higher than −40° C.

10. The process of claim 8 wherein the compound is present in the range of about 50 to 600 ppm.

11. The process of claim 8 wherein the compound is present in the range of about 75 to 500 ppm.

12. The process of claim 8 wherein the compound is present in the range of about 100 to 450 ppm.

13. The process of claim 8 further comprising adding a member selected from the group consisting of (1) a reaction product of (a) hydrocarbyl-substituted phenol wherein the hydrocarbyl substituent is substantially linear and contains an average of about 8 to about 40 carbon atoms with an aldehyde or a source thereof having between 1 to 10 carbon atoms;

(2) aromatic moieties containing from about 1 to 3 aromatic rings wherein the aromatic moieties contain up to three substituents substantially linear hydrocarbyl constituents having from about 1 to 50 carbon atoms and the aromatic moieties are coupled by alkylene groups having 1 to 100 carbon atoms;

(3) an ethylene vinyl acetate copolymer having an average molecular weight of between about 2,500 to 10,000 with a mole percent ethylene to vinyl acetate ratio of between about 65:35 to 85:15; and (4) mixtures thereof.

14. The process of claim 9 wherein the hydrocarbyl-substituted acylating agent is an alkenyl succinic anhydride.

* * * * *